US005837976A

United States Patent [19]

Loveless et al.

[11] Patent Number: 5,837,976

[45] Date of Patent: Nov. 17, 1998

[54] STRIP HEATING COIL APPARATUS WITH SERIES POWER SUPPLIES

[75] Inventors: Don L. Loveless, Sterling Heights, Mich.; Jean Lovens, Limbourg, Belgium

[73] Assignee: Inductotherm Corp., Rancocas, N.J.

[21] Appl. No.: 928,774

[22] Filed: Sep. 11, 1997

[51] Int. Cl.[6] ..... H05B 6/10; H05B 6/40

[52] U.S. Cl. ..... 219/645; 219/672; 219/673; 219/671

[58] Field of Search ..... 219/645, 635, 219/636, 646, 656, 660, 662, 671, 672, 673

[56] References Cited

U.S. PATENT DOCUMENTS

| | | | |
|---|---|---|---|
| 2,655,590 | 10/1953 | Gardner | 219/662 |
| 2,676,242 | 4/1954 | Witsenburg | 219/671 |
| 4,258,241 | 3/1981 | Soworowski | 219/656 |
| 5,001,319 | 3/1991 | Holmstrom | 219/671 |
| 5,317,121 | 5/1994 | Katayama et al. | 219/672 |
| 5,345,065 | 9/1994 | Reinke et al. | 219/672 |
| 5,495,094 | 2/1996 | Rowan et al. | 219/645 |

*Primary Examiner*—Philip H. Leung
*Attorney, Agent, or Firm*—Seidel, Gonda, Lavorgna & Monaco, PC

[57] ABSTRACT

An induction heating apparatus for heating continuous strip material. In a first embodiment, two coil sections each having a gap at one end for the strip material to pass edgewise into and out of the apparatus for heating wherein the coil sections are adapted for connection to two power supplies such that the first power supply connects through one half-turn of each of the coil sections, and thence to the second power supply, which is connected through the second half-turns of the respective coil sections and back to the first power supply, all in series. In a second embodiment, the coil sections are adapted for connection to four power supplies in series; each power supply connected to a respective half-turn of the coil sections, such that one half-turn is connected between each of the four power supplies. The series connection ensures uniform amplitude and phase of the electrical current applied to the induction heating coil apparatus.

6 Claims, 11 Drawing Sheets

STRIP HEATING COIL APPARATUS WITH SERIES POWER SUPPLIES

FIELD OF THE INVENTION

The present invention is related to the general field of induction heating of metals, and has particular utility in the field of galvannealing of continuous strip materials by induction heating.

BACKGROUND OF THE INVENTION

It has long been a practice in the metallurgy industry to employ induction heating means to galvanneal continuous strip metals, like strip steel, with other metal coatings (such as zinc or zinc-alloy) applied as liquids. The induction heating causes increased bonding into alloy phases between the strip material and the liquid metal coating. Galvannealed metals have known advantages over galvanized metals such as better welding and painting characteristics and improved corrosion resistance.

One of the most demanding applications for galvannealing metal strip by induction heating is heating a steel strip from about 850 degrees to 1050 degrees Fahrenheit after the strip has been galvanized through a zinc bath. This type of strip is used extensively in automotive body panels, for example.

In U.S. Pat. No. 5,495,094, an induction heating coil apparatus adapted for use with continuous strip materials was described. One aspect of that invention was the configuration of the induction coil sections in the apparatus, including the provision of a gap at one end of the apparatus that permitted strip material to pass into and out of the coil apparatus without the need for complex door assemblies. Another aspect of the previous invention was that the coil apparatus could be energized by separate power supplies to provide opposing currents in the respective half-turns of each full-turn section of the apparatus. Reference to U.S. Pat. No. 5,495,094 will give the reader a complete understanding of the earlier apparatus.

One embodiment of the previous invention can be used to illustrate the context of the present invention. Referring to FIG. 1 herein, a perspective view of one coil apparatus according to the previous invention, it can be seen that the coil apparatus 10 is a solenoidal structure comprising two coil sections 12, 14. One section 12 forms a full-turn coil on the upper half of the apparatus; the other section 14 forms the lower full-turn. The upper coil section 12 comprises two complementary half-turns 16, 18 and the lower coil section 14 comprises two complementary half-turns 20, 22 to form the full turns of each section of the apparatus. A first power supply 32 drives the upper 18 and lower 20 half-turns in the foreground portion of the apparatus shown in FIG. 1; a second power supply 34 drives the upper 16 and lower 22 half-turns in the rear of the apparatus shown in FIG. 1. A first power supply 32 drives the upper 18 and lower 20 half-turns in the foreground of FIG. 1; a second power supply 34 drives the upper 16 and lower 22 half-turns in the rear of the apparatus of FIG. 1.

In the previous invention, a complex configuration of interconnecting elements was necessary to make the power supply connections to drive the induction coil apparatus. The extension portions 24, 26 and interconnecting conductors 28, 30 were provided to facilitate connection of the two power supplies to drive the coil apparatus. In practice, these conductors increase the complexity of the coil structure; cause higher electrical resistance and resultant power losses, thereby reducing system efficiency; and cause an undesirable reactive voltage drop, requiring higher voltages to be generated by the power supplies. The two power supplies 32, 34 are electrically isolated, but must be operated at equal amplitudes in a 180 degree phase relationship to provide the current flows shown in FIG. 1 (by pathway arrows a and b) for proper operation of the coil apparatus. The necessity of maintaining the amplitude and phase relationships of the two power supplies requires additional control circuitry and system complexity. The present invention is a modification to both the configuration of the coil apparatus and the provision of power sources for the purpose of improving the overall system efficiency while reducing its complexity.

The simplified interconnecting elements of the present invention allow for another improvement over the previous invention. The introduction of flexible members in the interconnecting elements makes it possible to open wide the gap at the opposite end of the coil apparatus for removal of the continuous metal strip. Flexible members in the interconnecting elements also provide the ability to make the gap separating the shunt conductors very small during heating. A smaller gap reduces inductive voltage drop on the shunt conductors, minimizes the stray magnetic filed around the gap, and increases induction heating efficiency.

SUMMARY OF THE INVENTION

The present invention is a coil apparatus for induction heating continuous strip material. The coil apparatus comprises two coil sections in which complementary half-turns of electrical conductors form two full turn solenoids for induction heating the strip material. A gap is provided in one end of the coil apparatus for the strip material to pass through edgewise into and out of the coil apparatus. The configuration of the coil sections is adapted for connection to two alternating current power supplies that connect in series with the coil sections and each other to ensure uniform phase and amplitude of the power applied to the coil apparatus. In a second preferred embodiment of the invention, the coil sections are adapted for connection with four power supplies in a series configuration.

More particularly, the invention is an induction heating apparatus for heating continuous strip material comprising a solenoidal coil apparatus for induction heating comprising first and second coil sections. Each coil section comprises first and second complementary half-turns that form an effective full-turn coil through which strip material may pass. The coil sections are arranged longitudinally separated from each other in the direction of the path of the strip material through the apparatus. The first half-turn of the first coil section and the first half-turn of the second coil section are connected at one end of the apparatus by a first shunt conductor. The second half-turn of the first coil section is likewise connected at the same one end of the apparatus to the second half-turn of the second coil section by a second shunt conductor. The shunt conductors are separated from each other by a variable gap or a fixed gap of sufficient dimension to permit the strip material to pass into and out of the apparatus through the gap thus formed in said one end of the apparatus. The apparatus further comprises first and second alternating current power supplies each with two terminals for connection to the coil apparatus. The first power supply is connected at its first terminal to the first half-turn of the first coil section and at the other terminal to the second half-turn of the first coil section, said connection being made at the end of the apparatus opposite to the end having the shunt conductors. The connection may be either flexible or rigid. The second power supply is likewise connected at its first terminal to the first half-turn of the second coil section and at the other terminal to the second half-turn of the second coil section. The connection of the two power supplies to the coil apparatus forms a series electrical circuit for current passing through the coil apparatus at a given instant from the first power supply through the first half-turn of the first coil section, through a shunt conductor and the first half-turn of the second coil section into the second power supply, then from the second power supply into the second half-turn of the second coil section through a shunt conductor to the second half-turn of the first coil section and returning to the first power supply, said current reversing its direction at another instant corresponding to an opposite cycle of the alternating current power supplies.

In a second preferred embodiment, a solenoidal coil apparatus for induction heating comprises first and second coil sections, each coil section comprising first and second complementary half-turns that form an effective full-turn coil through which strip material may pass. The coil sections are arranged longitudinally separated from each other in the direction of the path of the strip material through the apparatus, and wherein each of the half-turns of the respective coil sections is separate from each of the other half-turns, being not connected to any of them. In this embodiment there are four power supplies, each connected in electrical series with one half-turn of the respective half-turns of the coil sections, such that a single half-turn is connected between each of the power supplies. The connection of the power supplies to the coil half-turns is from a first power supply terminal through the first half-turn of the first coil section to a second power supply, from the second power supply through the first half-turn of the second coil section to a third power supply, from the third power supply through the second half-turn of the second coil section to the fourth power supply, and from the fourth power supply through the second half-turn of the first coil section back to the first power supply in series.

DESCRIPTION OF THE DRAWINGS

For the purpose of illustrating the invention, there are shown in the drawings forms which are presently preferred; it being understood however, that this invention is not limited to the precise arrangements and instrumentalities shown.

DESCRIPTION OF THE INVENTION

Figure 2:
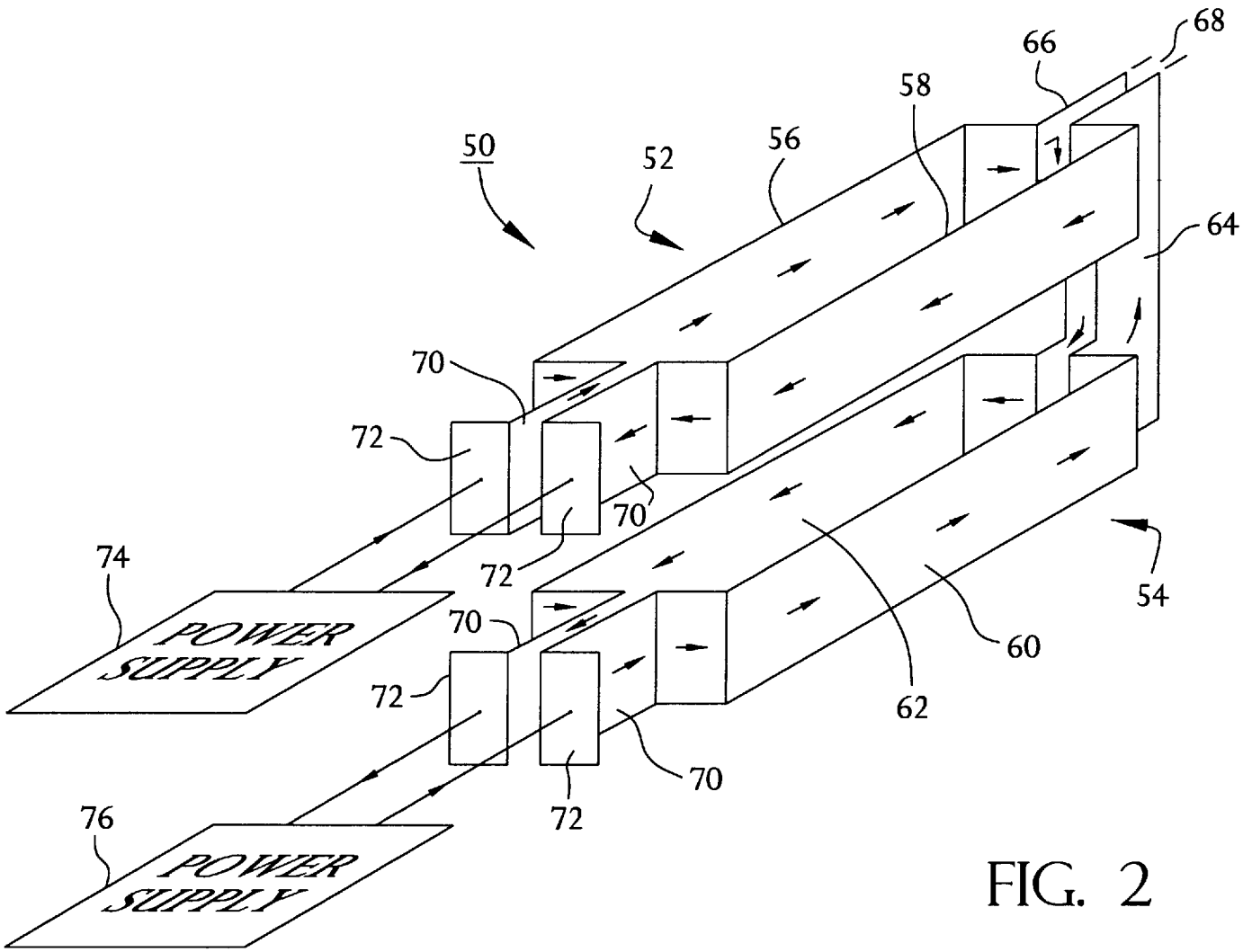
FIG. 2 is a perspective view of a coil apparatus according to the present invention.

Referring now to the drawings, in which like reference numerals indicate like elements, FIG. 2 illustrates a form of continuous strip material heating coil apparatus 50 according to the present invention. The coil apparatus 50 comprises upper 52 and lower 54 coil sections that, together, form a two-turn solenoidal coil apparatus for heating continuous strip material. The upper coil section 52 comprises two complementary half-turns 56, 58 that, in combination, operate as a full-turn of the solenoidal coil apparatus 50. Likewise, the lower coil section 54 comprises two complementary half-turns 60, 62. The respective half-turns of both coil sections are arranged such that they extend transverse to the longitudinal axis of the strip material workpiece (not shown in the Figure) and on both sides of it.

The half-turns 56, 58 comprising the upper coil section 52 are not connected to each other at any point, nor are the two half-turns 60, 62 in the lower coil section 54 connected together. Rather, as shown in FIG. 2, the upper half-turn 58 in the foreground of the upper coil section is connected to the lower half-turn 60 in the foreground of the lower coil section 54 of the apparatus 50 through a shunt conductor 64. Similarly, the upper half-turn 56 in the rear of the upper coil section 52 (in FIG. 2) connects to the lower half-turn 62 of the lower section 54 in the rear of the coil apparatus 50 through a shunt conductor 66. A gap 68 between the respective shunt conductors 64, 66 permits the movement of continuous strip material (not shown) into and out of the coil apparatus 50.

The described configuration establishes current flow in the coil apparatus in two paths, which are connected in series through two power supplies 74, 76. The current flow at a given instant is shown by the arrows in FIG. 2. Current may flow from the lower 60 to the upper half-turn 58 on the front of the apparatus through the shunt conductor 64. This pattern insures that the current moves in opposite directions on the front of the apparatus. The same configuration on the rear of the apparatus produces the same result in the upper 56 and lower 62 half-turns connected by a shunt conductor 66. It can also be seen in FIG. 2 that the current flows in opposing directions in the two half turns 56, 58 of the upper coil section 52. The same is true of the current in the half-turns 60, 62 of the lower coil section 54. Opposing current flows in the respective half-turns of each coil section create longitudinal electromagnetic fields through which the strip material workpiece (not shown) passes. This maximizes and concentrates induced eddy currents in the workpiece which, in turn, causes efficient heating.

The coil apparatus 50 is configured for connection to power supplies at the end opposite the gap 68. Each of the four half-turns 56, 58, 60, 62 of the upper and lower coil sections 52, 54 comprises an extension conductor 70 ending in a terminal 72 for connection to one of two power supplies 74, 76. A first power supply 74 is connected to the terminals 72 of the upper coil section 52; the second power supply is connected to the terminals 72 of the lower coil section 54.

The connection of the power supplies and coil sections in this manner forms a single series electric circuit. The connection of the power supplies to the coil assembly is simplified by the arrangement of the coil elements, extension conductors, and terminals. Power loss and voltage drop attributable to this connection are minimized in comparison to the earlier form of coil apparatus described in relation to FIG. 1. There is only one series circuit, ensuring equal current in all coil segments and proper phase relationships throughout the apparatus because the same current flows in both power supplies and in all coil segments.

Figure 1:
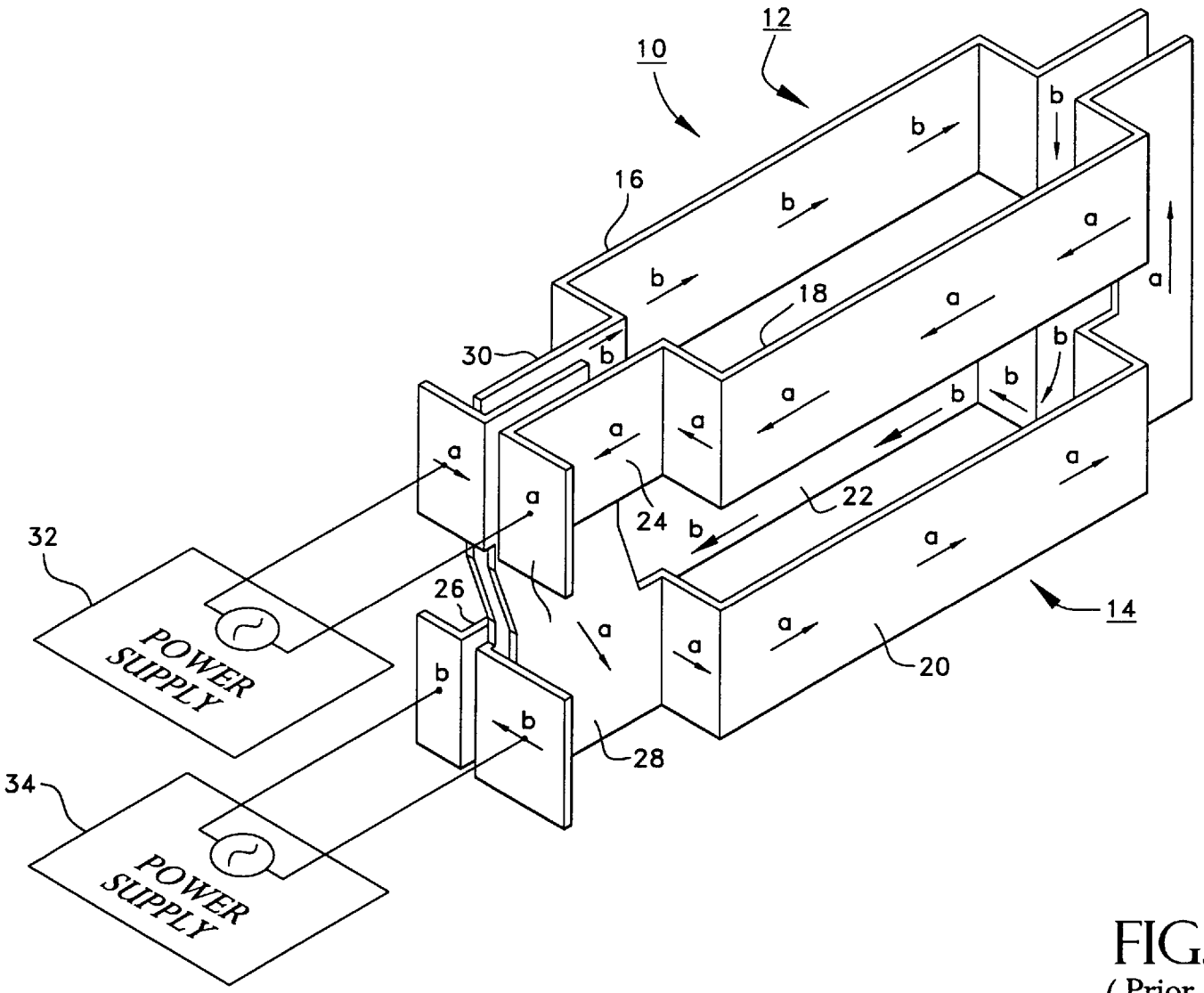
FIG. 1 (Prior Art)
FIG. 1 is a perspective view of a coil apparatus according to the prior art.
Figure 3A:
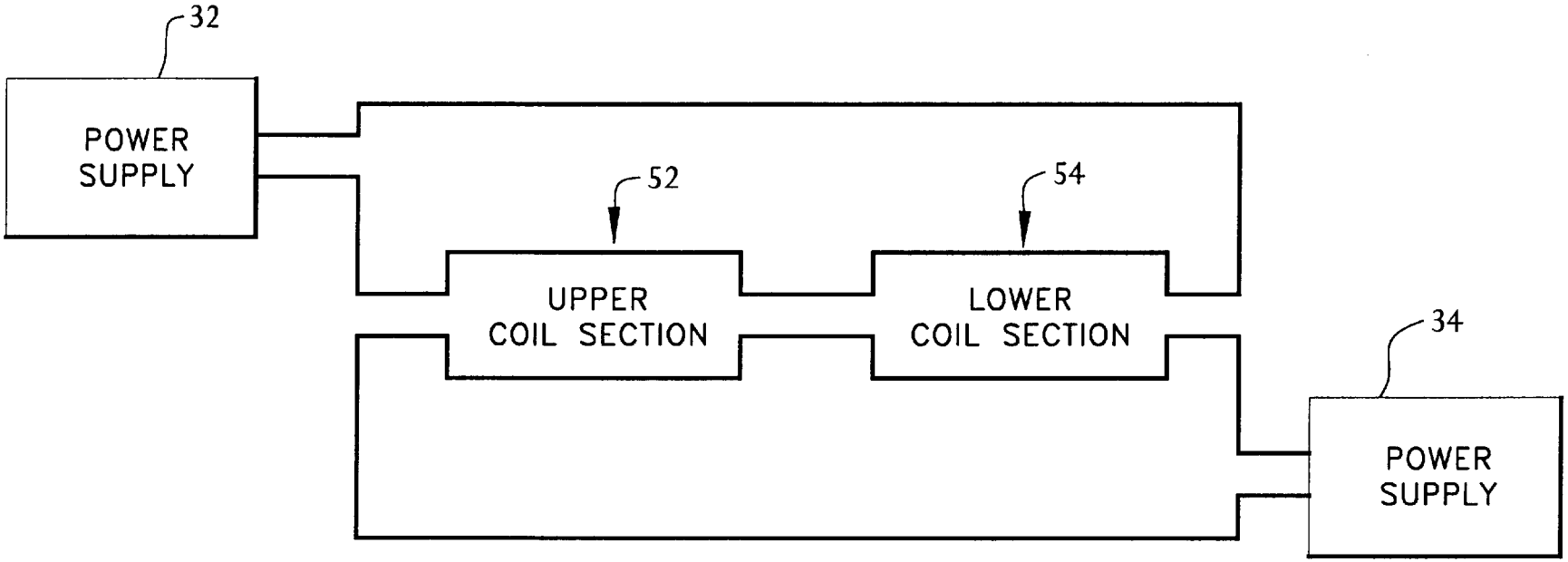
FIG. 3a ( Prior Art )
FIG. 3*a* is a schematic diagram of the electrical configuration of the coil apparatus of FIG. 1.
Figure 3B:
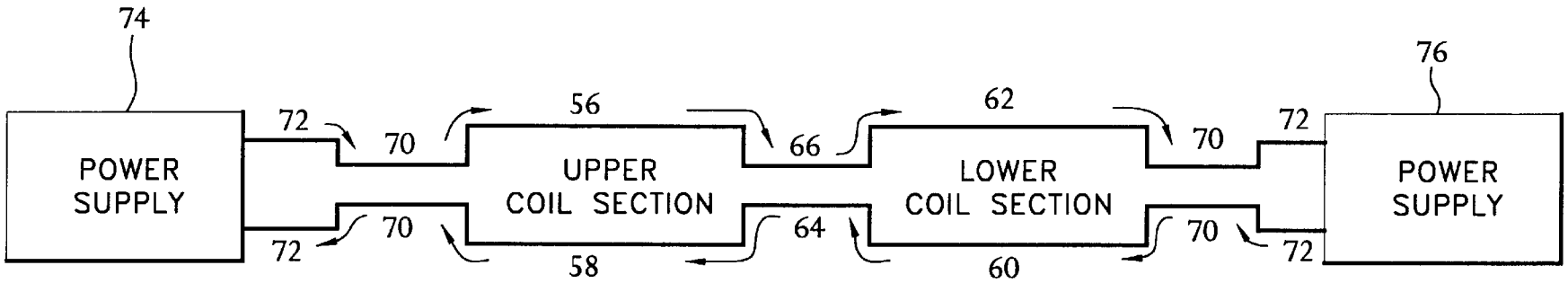
FIG. 3*b* is a schematic diagram of the electrical configuration of the coil apparatus of FIG. 2.

Reference to FIGS. 3*a* and 3*b* schematically illustrate the difference between the circuit configurations of the apparatus of FIG. 1 and that of FIG. 2. In FIG. 3*a,* the current paths of the power supplies 32, 34 are electrically isolated from each other. Each drives the current in one half-turn of the respective upper and lower coil sections. This configuration has the disadvantages of requiring complex circuits to maintain precise phase and amplitude control in the two power supplies so that they energize the coil apparatus correctly.

The configuration of the present invention provides a significantly different and advantageous arrangement. In FIG. 3*b,* which schematically illustrates the electrical configuration of FIG. 2, the first power supply 74 drives current (the arrow in the figure) into the first half-turn 56 of the upper coil section, through the shunt conductor 66 into the half-turn 62 that connects to the second power supply 76. The second power supply 76 drives current through the other two half-turns 60, 58 and back to the first power supply 74. The power supplies are in series connection to one another, with the coil half-turns all in series connection too. A major advantage of this configuration is that series connection of the power supplies and the coil elements guarantees that the current in all of the coil elements will be equal and of the correct phase. The same current flows in all of the power supplies and in all coil segments in a series circuit.

The induction heating power supplies 74, 76 include load resonating capacitors which, when connected to the present induction coil apparatus (FIG. 2), form a series resonant circuit. The natural frequency of this circuit is established by the formula:

$$F = 1/2\pi\sqrt{LC}$$

The power supplies must be capable of operation when series-connected with others. This means that all of the power supplies are synchronized to each other and to the series resonant circuit current. There are two basic inverter circuit configurations commonly used for induction heating power supplies. They are referred to here as current fed and voltage fed. Both configurations can be series connected and can be used in the described embodiments.

Figure 4A:
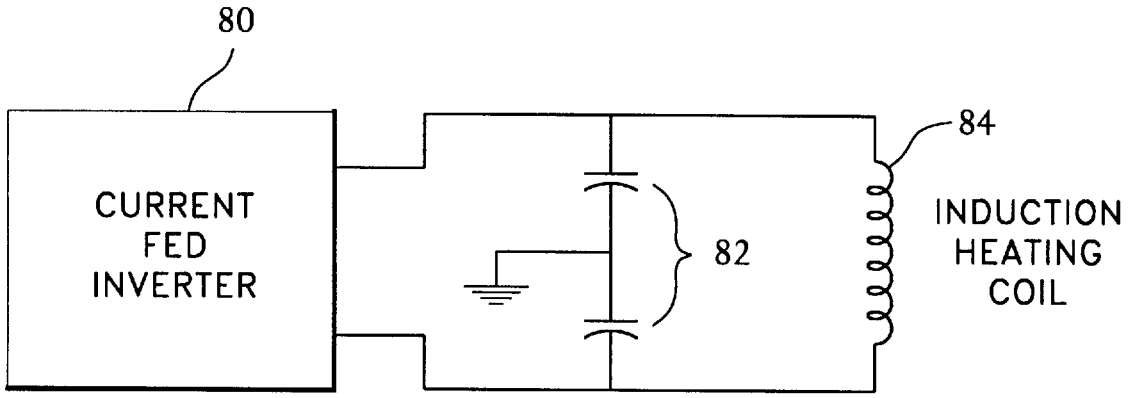
FIG. 4*a* is a schematic diagram of the electrical circuit of an induction heating coil powered by a current fed inverter power supply.
Figure 4B:
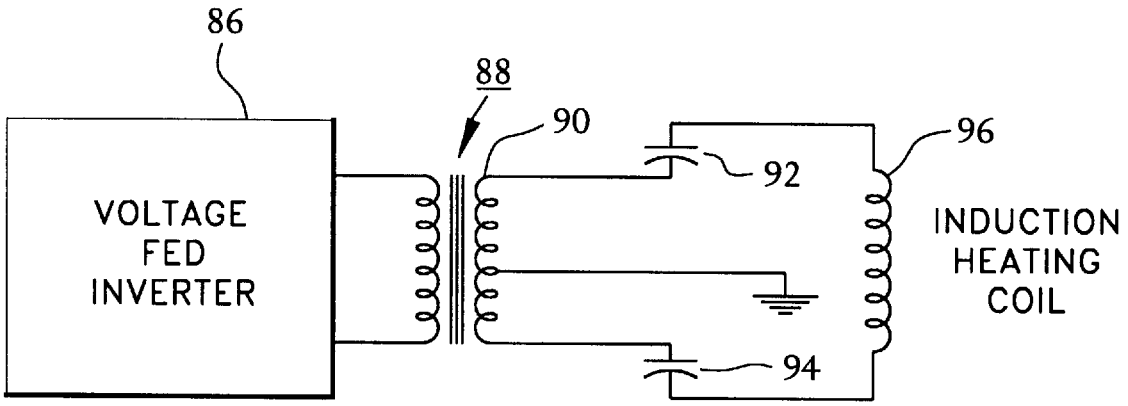
FIG. 4*b* is a schematic diagram of the electrical circuit of an induction heating coil powered by a voltage fed inverter power supply.

The current fed and voltage fed power supply configurations are illustrated in FIGS. 4*a* and 4*b* respectively. The output of the current fed inverter 80 is connected across a capacitor 82 that, along with the induction heating coil 84, forms a resonant circuit. The capacitor 82 is commonly divided into two equal series sections with the connection to the midpoint connected to an electrical ground, as illustrated in FIG. 4*a*. The output of the voltage fed inverter 86 is connected to an isolation transformer 88 having a secondary winding 90 that commonly has a center tap connection to ground. As illustrated in FIG. 4*b,* the secondary winding 90 of the transformer 88 is connected in series with the circuit consisting of the capacitors 92, 94 and induction heating coil 96 that form a resonant circuit.

Figure 5:
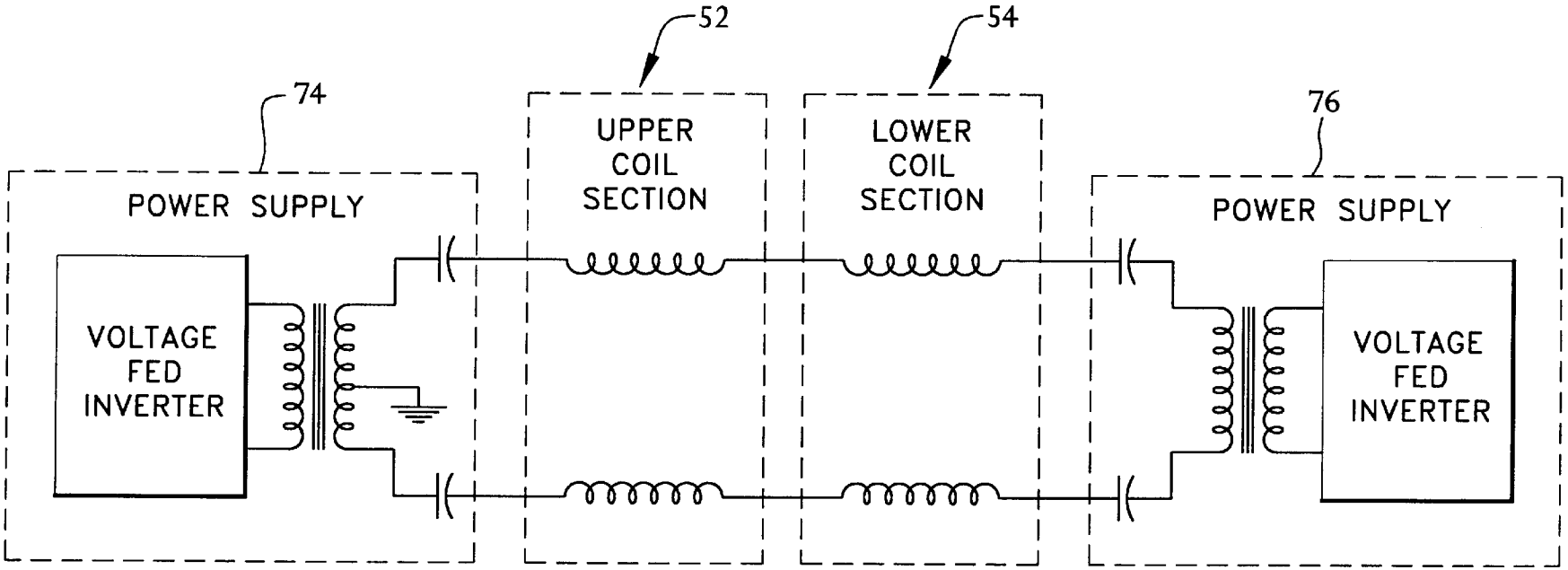
FIG. 5 is a schematic diagram of the electrical circuit of the coil apparatus in FIG. 2.

One of the power supplies connected to an induction coil apparatus as disclosed herein should be connected to electrical ground to minimize the voltage on all coil sections, interconnections, and power supply connections. This is an important feature where the induction heating coil apparatus is used in an environment where arcing or corona would present a hazard. FIG. 5 is the electrical schematic of the first arrangement shown in FIG. 2 where the power supplies are of the voltage fed inverter configuration.

Figure 6:
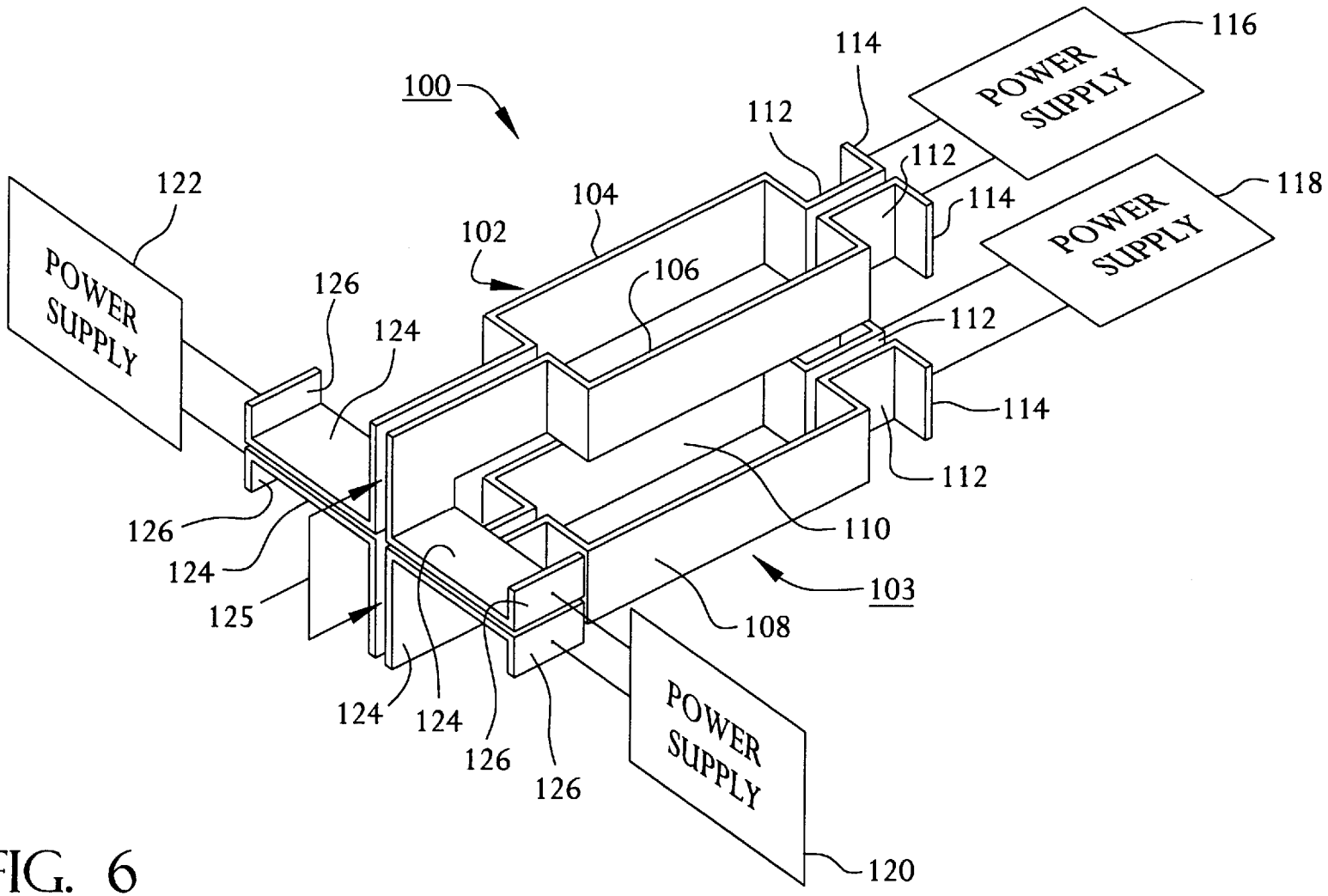
FIG. 6 is a perspective view of an embodiment of a strip heating coil apparatus adapted for four power supplies.

Another preferred embodiment of the invention is illustrated in FIG. 6. This coil apparatus 100 comprises two coil sections 102, 103 having complementary half-turns 104, 106, 108, 110 in a solenoidal configuration for heating continuous strip material (not shown). At a first end of the apparatus, extension portions 112 lead to terminals 114 to which two power supplies 116, 118 are connected. In contrast to the previously described embodiment of FIG. 3, the opposite end of the apparatus does not have shunt conductors connecting the upper 102 and lower 103 coil sections. Instead, the configuration of FIG. 6 enables the connection of two more power supplies 120, 122 to the apparatus.

At the end of each of the four respective half-turns 104, 106, 108, 110 of the apparatus, extension conductors 124 lead to terminals 126 that are connected to the power supplies 120, 122. In the described embodiment, the extension conductors 124 are arranged in a right angle perpendicular to the plane of the strip material workpiece (not shown) that moves through the coil apparatus. This arrangement provides a longitudinal gap 125 between pairs of extension conductors. The strip material (not shown) is positioned in and removed from the coil apparatus edgewise through the gap 125. Other arrangements of these extension conductors are possible. The configuration of the extension conductors 124 and terminals 126 at the second end of the apparatus is such that each of the power supplies 120, 122 is connected to one half-turn of the upper coil section 102 and the adjacent half-turn of the lower coil section 103.

In this embodiment of the invention, the total voltage applied to the induction heating coil apparatus is approximately four times the output voltage of each power supply, and the total power delivered to the coil is four times the output of each power supply. The ability to deliver this higher voltage and higher power is especially important when heating very wide metal strip. In this case, the larger coil opening required to accommodate the wide strip results in higher coil inductance and thus requires higher coil voltage.

Figure 7:
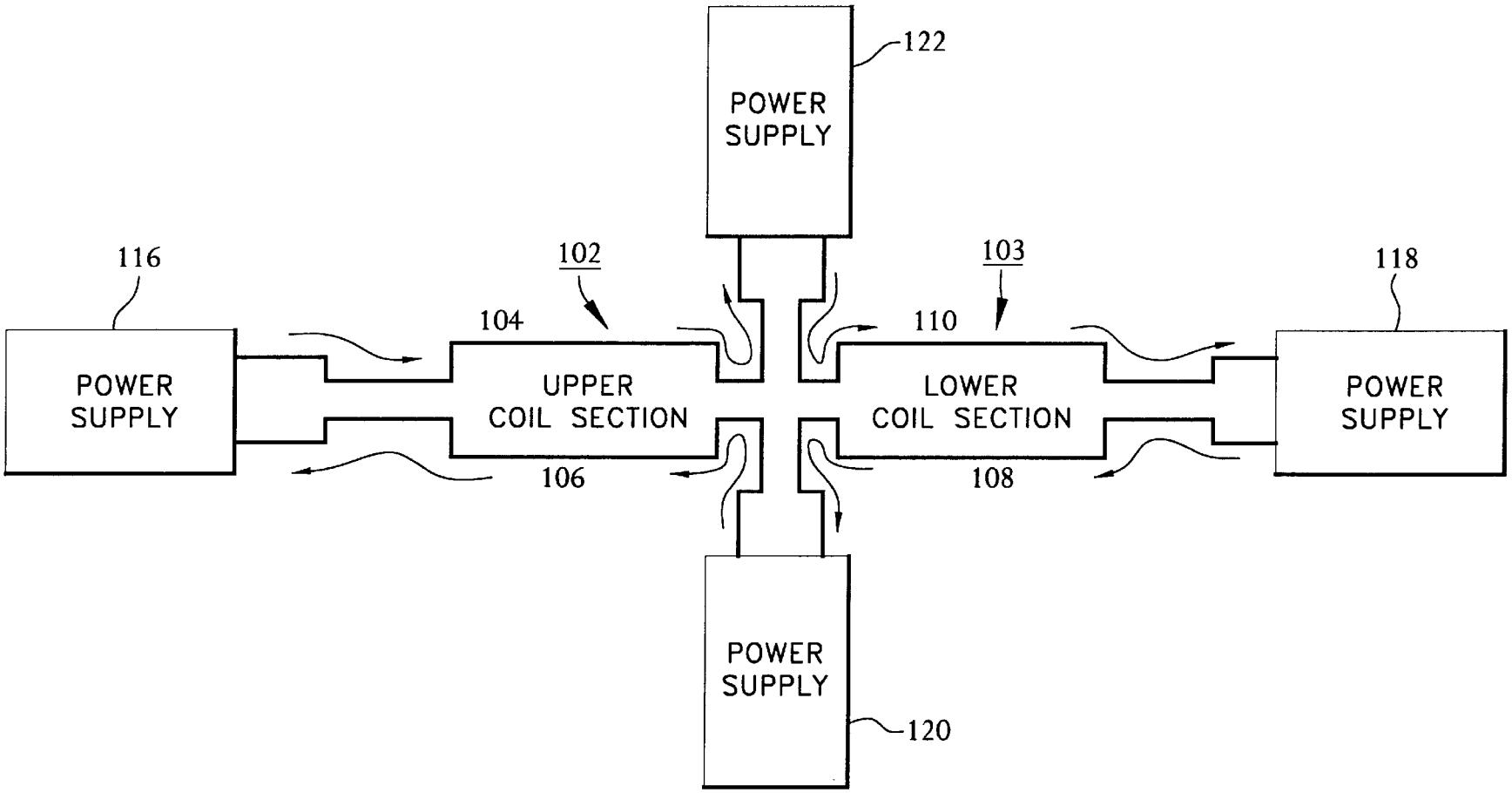
FIG. 7 is a schematic view of the electrical configuration of the coil apparatus of FIG. 6.

The resulting electrical configuration of the apparatus of FIG. 6 is another series-connected arrangement of power supplies and coil elements. Referring to FIG. 7, the configuration is schematically illustrated showing the four power supplies and the two coil sections. At a given instant of time, current in the apparatus is driven from the first power supply 116, through one half-turn 104 of the upper coil section 102, into a second power supply 122, through one half-turn 110 of the lower coil section 103, into a third power supply 118, through the other half-turn 108 of the lower coil section 103, into the fourth power supply 120, then through the other half-turn 106 of the upper coil section 102 and back to the first power supply 116. On the next cycle of the four alternating current power supplies, the current flow direction reverses but continues to be in series through each of the half-turns of the coil apparatus and the power supplies.

Figure 8:
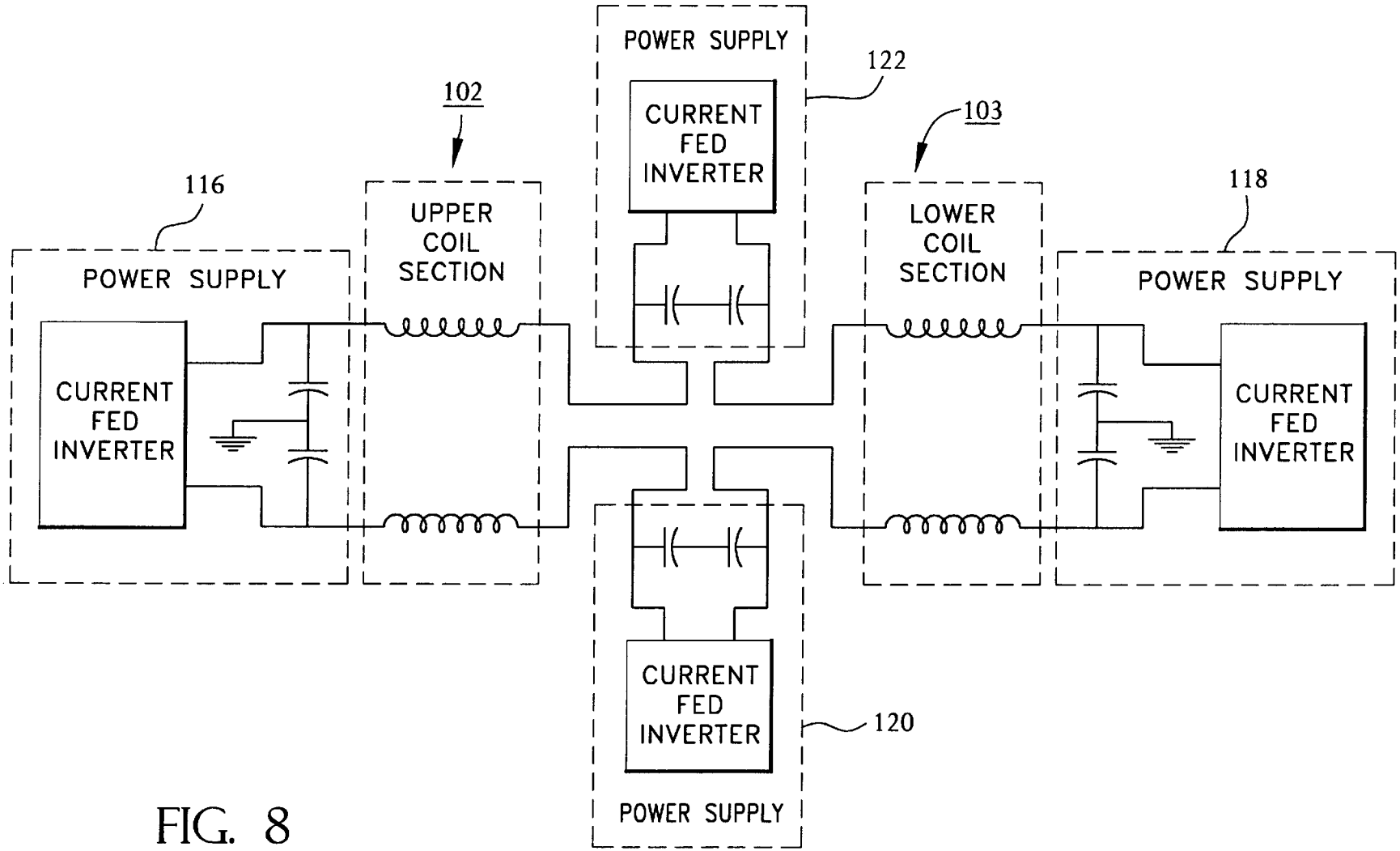
FIG. 8 is a schematic view of the electrical circuit of the coil apparatus in FIG. 6.

The power supplies employed in the embodiment of the invention shown in FIGS. 6 and 7 are current fed inverter supplies. The current fed inverter power supply was described above and illustrated in FIG. 4*a*. FIG. 8 is the electrical schematic of the second coil apparatus arrangement as shown in FIGS. 6 and 7, where the power supplies shown are current fed inverters. As in the previously described embodiment of the invention, at least one of the power supplies should be connected to electrical ground to minimize the voltage on all coil sections, interconnections and power supply connections.

Figure 9A:
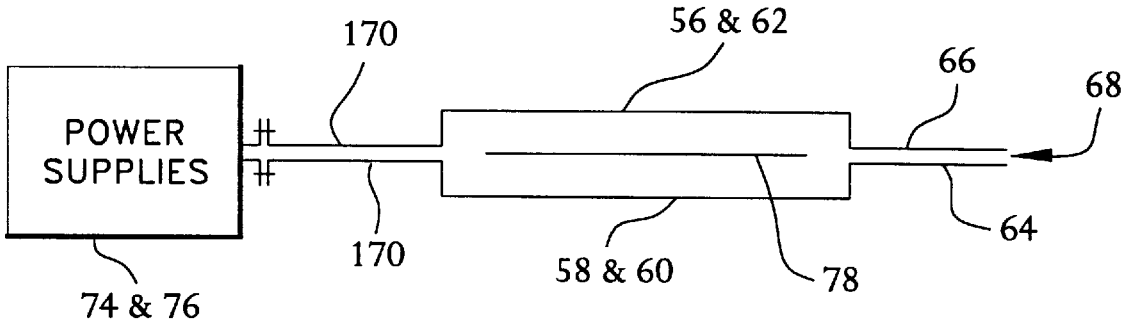
FIGS. 9*a* and 9*b* illustrate a top view of a symmetrical coil apparatus according to the invention, showing flexible interconnecting elements allowing closed and open positions, respectively.
Figure 9B:
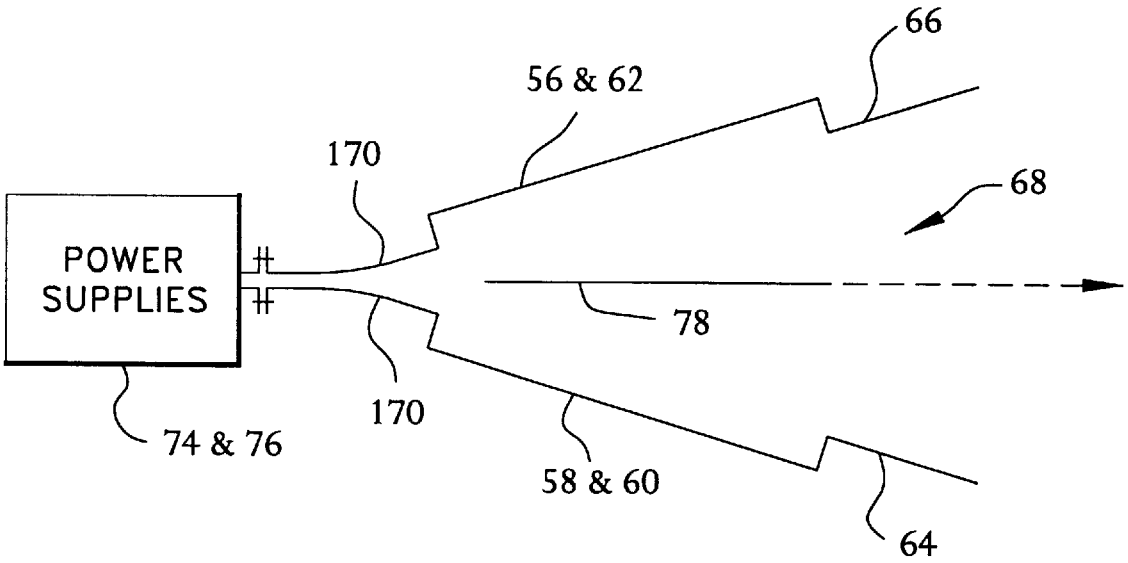

FIGS. 9*a* and 9*b* illustrate the use of flexible interconnecting members 170 between the power supplies 74 and 76 and coil half turns 56, 62, 58, and 60. FIG. 9*a* shows the coil apparatus and strip 78 in the heating position, with the shunt conductors 64 and 66 close to each other. This configuration improves coil performance by decreasing inductive voltage drop on the shunt conductors 64 and 66 and minimizes stray magnetic field around the gap 68. FIG. 9*b* illustrates the coil apparatus with interconnecting members 170 flexed to provide a wide gap 68 between the shunt conductors 64 and 66. In this position, the metallic strip 78 can easily pass through the gap 68 to move it into and remove it from the heating position within the coil apparatus.

Figure 10A:
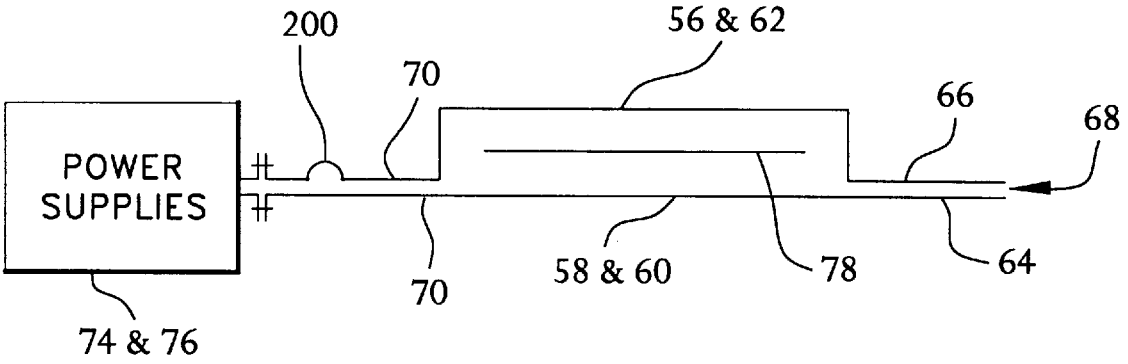
FIGS. 10*a* and 10*b* illustrate a top view of an asymmetrical coil apparatus according to the invention, showing flexible interconnecting elements allowing closed and open positions.
Figure 10B:
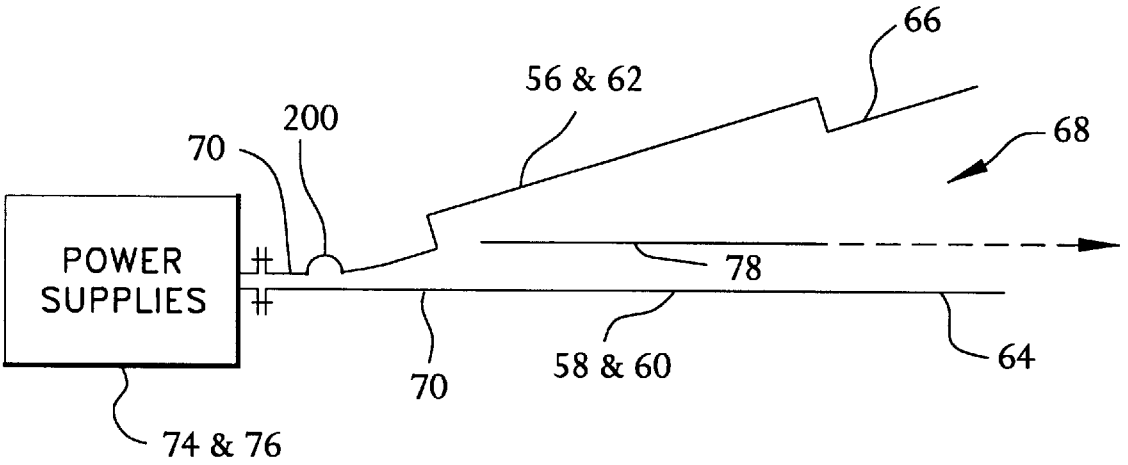

Another arrangement, illustrating the use of a flexible electrically conductive joint 200 between the interconnecting members 70, is shown in FIGS. 10*a* and 10*b*. The coil apparatus shown is asymmetrical with a flexible joint 200 provided in the interconnecting members 70 of only one half of the coil apparatus. FIG. 10*a* illustrates the coil apparatus and strip 78 in the closed, heating position. FIG. 10*b* illustrates the coil apparatus with the flexible joint 200 in the interconnecting elements 70 being opened to allow one half of the coil to be moved to provide a wide gap 68 between the shunt conductors 64 and 66. With the interconnecting elements 70 in this position, the strip 78 can easily be inserted into or withdrawn from the heating position in the coil.

The present invention may be embodied in other specific forms without departing from the spirit or essential attributes thereof and, accordingly, reference should be made to the appended claims, rather than to the foregoing specification, as indicating the scope of the invention.

We claim:

1. An induction heating apparatus for heating continuous strip material comprising:

a solenoidal coil apparatus for induction heating comprising first and second coil sections, each coil section comprising first and second complementary half-turns that form an effective full-turn coil through which strip material may pass, wherein the coil sections are arranged longitudinally separated from each other in the direction of the path of the strip material through the apparatus, the first half-turn of the first coil section and the first half-turn of the second coil section being connected at one end of the apparatus by a first shunt conductor, the second half-turn of the first coil section being likewise connected at the same one end of the apparatus to the second half-turn of the second coil section by a second shunt conductor, said shunt conductors being separated from each other by a gap of sufficient dimension to permit the strip material be positioned in and removed from the apparatus edgewise through the gap thus formed in said one end of the apparatus;

said apparatus further comprising first and second alternating current power supplies each with two terminals for connection to the coil apparatus, the first power supply being connected at its first terminal to the first half-turn of the first coil section and at the other terminal to the second half-turn of the first coil section, said connection being made at the end of the apparatus opposite to the end having the shunt conductors, said second power supply likewise being connected at its first terminal to the first half-turn of the second coil section and at the other terminal to the second half-turn of the second coil section, said connection of the two power supplies to the coil apparatus forming a series electrical circuit for current passing through the coil apparatus at a given instant from the first power supply through the first half-turn of the first coil section, through a shunt conductor and the first half-turn of the second coil section into the second power supply, then from the second power supply into the second half-turn of the second coil section through a shunt conductor to the second half-turn of the first coil section and returning to the first power supply, said current reversing its direction at another instant corresponding to an opposite cycle of the alternating current power supplies.

2. The induction heating apparatus of claim 1, wherein the connection between the power supplies and the coil turns comprises at least one electrically conductive flexible element.

3. The induction heating apparatus of claim 2, wherein the connection between the power supplies and the coil turns includes an electrically conductive flexible joint.

4. An induction heating apparatus for heating continuous strip material comprising:

a solenoidal coil apparatus for induction heating comprising first and second coil sections, each coil section comprising first and second complementary half-turns that form an effective full-turn coil through which strip material may pass, wherein the coil sections are arranged longitudinally separated from each other in the direction of the path of the strip material through the apparatus, and wherein each of the half-turns of the respective coil sections is separate from each of the other half-turns, and not connected to any of them;

and four power supplies, each power supply respectively connected in electrical series with one half-turn of the respective half-turns of the coil sections, such that one half-turn is connected between each of the respective power supplies.

5. The induction heating apparatus of claim 4, wherein the connection of the power supplies to the coil half-turns is from a first power supply terminal through the first half-turn of the first coil section to a second power supply, from the second power supply through the first half-turn of the second coil section to a third power supply, from the third power supply through the second half-turn of the second coil section to the fourth power supply, and from the fourth power supply through the second half-turn of the first coil section back to the first power supply in series.

6. The induction heating apparatus of claim 5, wherein the connections between the first power supply and the coil turns and the connections between the coil turns and the fourth power supply include an electrically conductive flexible element.

* * * * *